US010064444B2

(12) United States Patent
Glezerman et al.

(10) Patent No.: US 10,064,444 B2
(45) Date of Patent: Sep. 4, 2018

(54) HELMET WITH CHEEK-EMBEDDED MICROPHONE

(71) Applicant: CARDO SYSTEMS INC., Pittsburg, PA (US)

(72) Inventors: Abraham Glezerman, Tel Aviv (IL); Abraham Avi Moato, Rishon Lezion (IL)

(73) Assignee: Cardio Systems Inc., Pittsburgh, PA (US)

( * ) Notice: Subject to any disclaimer, the term of this patent is extended or adjusted under 35 U.S.C. 154(b) by 226 days.

(21) Appl. No.: 14/768,644

(22) PCT Filed: Feb. 19, 2014

(86) PCT No.: PCT/IL2014/050182

§ 371 (c)(1),
(2) Date: Aug. 18, 2015

(87) PCT Pub. No.: WO2014/128704

PCT Pub. Date: Aug. 28, 2014

(65) Prior Publication Data

US 2016/0000171 A1 Jan. 7, 2016

Related U.S. Application Data

(60) Provisional application No. 61/767,320, filed on Feb. 21, 2013, provisional application No. 61/767,327, filed on Feb. 21, 2013.

(51) Int. Cl.
*A42B 3/30* (2006.01)
*A42B 3/12* (2006.01)

(52) U.S. Cl.
CPC . *A42B 3/30* (2013.01); *A42B 3/12* (2013.01)

(58) Field of Classification Search
CPC .. A42B 3/30; A42B 3/12; A42B 3/303; A42B 3/306

(Continued)

(56) References Cited

U.S. PATENT DOCUMENTS 3,087,028 A 4/1963 Bonnin
4,166,978 A 9/1979 White et al.

(Continued)

FOREIGN PATENT DOCUMENTS

CN 101834916 A 9/2010
EP 1099390 A1 * 5/2001 ..... A42B 3/30

(Continued)

OTHER PUBLICATIONS

International Search Report for corresponding PCT application, dated May 28, 2014, 5 pages.

(Continued)

*Primary Examiner* — Alissa Tompkins
*Assistant Examiner* — Griffin Hall
(74) *Attorney, Agent, or Firm* — Roach, Brown, McCarthy & Gruber, P.C.; Kevin D. McCarthy

(57) ABSTRACT

The invention relates to a protective helmet which is provided with communication equipment, the helmet comprises one or more microphones that are embedded next to cheeks of the wearer in one or more layers of material that are located between a helmet shell and said wearer's cheeks, wherein each of said one or more microphones is connected directly or indirectly to said communication equipment by means of a connection element, each of said connection elements being also embedded respectively within slots that are made within one or more of said layers.

8 Claims, 6 Drawing Sheets

(58) Field of Classification Search
USPC ..... 2/6.1, 412
See application file for complete search history.

(56) References Cited

U.S. PATENT DOCUMENTS

| | | | | | |
|---|---|---|---|---|---|
| 4,471,174 | A | | 9/1984 | Nava | |
| 4,517,417 | A | * | 5/1985 | Murayama | H04R 1/08 379/430 |
| 4,524,461 | A | * | 6/1985 | Kostanty | A42B 3/30 455/351 |
| 5,119,505 | A | | 6/1992 | Tisseront | |
| 5,136,657 | A | * | 8/1992 | Hattori | A42B 3/127 2/421 |
| 5,404,577 | A | * | 4/1995 | Zuckerman | A42B 3/30 455/351 |
| 5,678,205 | A | * | 10/1997 | Gray | A42B 3/10 455/348 |
| 6,075,857 | A | * | 6/2000 | Doss, Jr. | A42B 3/30 379/430 |
| 7,616,774 | B2 | * | 11/2009 | Lazzeroni | A42B 3/30 379/430 |
| 8,201,274 | B2 | * | 6/2012 | Ellis | A42B 3/30 2/410 |
| 8,667,617 | B2 | * | 3/2014 | Glezerman | A42B 3/30 2/410 |
| 2002/0176595 | A1 | | 11/2002 | Lazzeroni | |
| 2006/0062416 | A1 | | 3/2006 | Wu | |
| 2007/0037615 | A1 | | 2/2007 | Glezerman | |
| 2012/0051548 | A1 | * | 3/2012 | Visser | G10L 21/0208 381/56 |
| 2012/0190315 | A1 | * | 7/2012 | Glezerman | A42B 3/04 455/90.3 |
| 2012/0272435 | A1 | * | 11/2012 | Glezerman | A42B 3/30 2/411 |
| 2016/0100649 | A1 | * | 4/2016 | Glezerman | A42B 3/04 455/41.2 |
| 2017/0141460 | A1 | * | 5/2017 | Glezerman | H01Q 1/276 |

FOREIGN PATENT DOCUMENTS

| | | | | | |
|---|---|---|---|---|---|
| EP | 1341362 | A2 | | 9/2003 | |
| EP | 2674048 | A1 | * | 12/2013 | A42B 3/30 |
| JP | S61288525 | | | 12/1986 | |
| JP | 2007051395 | A | | 3/2007 | |
| WO | 2006004796 | A2 | | 1/2006 | |
| WO | 2008053502 | A1 | | 5/2008 | |
| WO | 2013176997 | A1 | | 11/2013 | |

OTHER PUBLICATIONS

Corrected version of International Preliminary Report on Patentability for corresponding PCT application, dated May 10, 2015; 11 pages.

http://makezine.com/projects/make-38-cameras-and-av/piezo-contact-mic—according to The Wayback Machine at http://web.archive.org/web/*/http://makezine.com/projects/make-38-cameras-and-av/piezo-contact-mic; that website was saved 29 times between Mar. 15, 2014 and Oct. 18, 2014—14 pages, printed on Mar. 15, 2015.

http://en.wikipedia.org/wiki/Bone_conduction—according to The Wayback Machine at http://web.archive.org/web/*/http://en.wikipedia.org/wiki/Bone_conduction; that website was saved 59 times between Jan. 21, 2005 and Jul. 13, 2015—2 pages.

* cited by examiner

HELMET WITH CHEEK-EMBEDDED MICROPHONE

FIELD OF THE INVENTION

The present invention relates to the field of protective headgear. More particularly, the invention relates to a helmet provided with communication means.

BACKGROUND OF THE INVENTION

Protective headgear is used in a variety of applications to protect the head of people engaging in sports, leisure activities and work. Some illustrative examples of activities requiring protective headgear include cycling and motorcycling, skiing, skydiving, mountain climbing and construction work.

Throughout this description the term "helmet" will be used to indicate protective headgear of any type, and illustrative helmet will be described, it being understood that the invention is not limited in any way to any particular type of protective headgear and is meant to encompass any shape, form, construction material, etc. of which protective headgear may be made.

When group activities are undertaken (the term "group" being meant to indicate two or more individuals) it is highly desirable to provide means by which members of the group can communicate among them. This is particularly important when members of the group find themselves at a distance from one another, or when the surrounding noise makes speech difficult or impossible, as may be the case with a driver and a passenger on the same motorcycle, who cannot converse because of the rushing wind.

Although headgear with communication capabilities has been on the market for quite some time, prior art products still suffer from communication of unsatisfactory quality, due to surrounding noise that is transmitted from the microphone, such as wind blowing into the microphone, motor noises, etc.

In another aspect, typical helmets with communication capabilities are inconvenient for use, particularly in view of their microphone structure. Typical communication systems for helmets comprise three main components: (a) a transceiver headset; (b) one or more speakers; and (c) a microphone arrangement which is provided external of the helmet which comprises a boom and microphone at its distal end, the proximal end of the boom is connected to the headset. The boom is substantially a rigid sleeve, in which one or more of electric wires convey sound signals from the microphone to the headset (sometimes the wires from the headset pass via a speaker, and from the speakers they are included within a boom the leads these wires to the microphone). When used on board of a motorcycle, and in view of a strong wind, the external microphone and its boom vibrate, sometimes they impact the helmet frame and the wearer's teeth, resulting in a significant reduction of the sound quality, which in any case is located in a very noisy environment. Moreover, the reliability of such external microphone arrangement is further reduced, in view of the microphone exposure to wind and rain.

Furthermore, the prior art arrangement of an external is very inconvenient to the user. Besides the fact that the microphone may impact the user's teeth (as particularly happens in a helmet with a front opening), this arrangement is also inconvenient during wearing or removal of the helmet.

It is an object of the present invention to provide protective helmet that substantially improves over existing, prior art protective helmets in terms of quality and clarity of communication.

It is another object of the invention to provide a helmet that, while providing an improved communication quality and clarity compared to the prior art, the helmet retains and even improves on wearing convenience.

Other objects and advantages of the invention will become apparent as the description proceeds.

SUMMARY OF THE INVENTION

The invention relates to a protective helmet which is provided with communication equipment, the helmet comprises one or more microphones that are embedded next to cheeks of the wearer in one or more layers of material that are located between a helmet shell and said wearer's cheeks, wherein each of said one or more microphones is connected directly or indirectly to said communication equipment by means of a connection element, each of said connection elements being also embedded respectively within slots that are made within one or more of said layers.

As used herein, the terms "embedding" and "embedded" are meant to indicate that the microphone is located in close proximity to an inner padding of the protective helmet and is meant to encompass the case in which a part or all of the microphone is located below the inner surface of the helmet padding (such as the cheek pad). The microphone may be attached to the helmet or helmet padding (layer) by any suitable means, such as using a Velcro or mechanical connector.

While the protective headgear according to the invention is not limited to any particular use, one of the embodiments of the invention is a helmet adapted to be used by a motorcycle driver and/or passenger. As will be appreciated by the skilled person, the invention encompasses all types of helmets and of protective headgear in general, and is not limited to any particular type of helmet or use.

Preferably, said communication equipment is a headset, and wherein each of said connection elements is flexible or rigid.

Preferably, the helmet is of a front-open type, and wherein the microphones are located remote from a respective proximate end of the wearer's mouth by at least 30 mm.

Preferably, said one or more layers are a mid-layer and an interior layer.

Preferably, the connection element is rigid, having a form of a boom.

Preferably, the flexible or rigid connection element is connected to an inner speaker.

Preferably, the helmet is adapted to be used by a motorcycle driver and/or passenger.

Preferably, the headset is suitable to provide voice operated functions.

Preferably, the headset is suitable to provide entertainment functions.

DETAILED DESCRIPTION OF THE INVENTION

Figure 1:
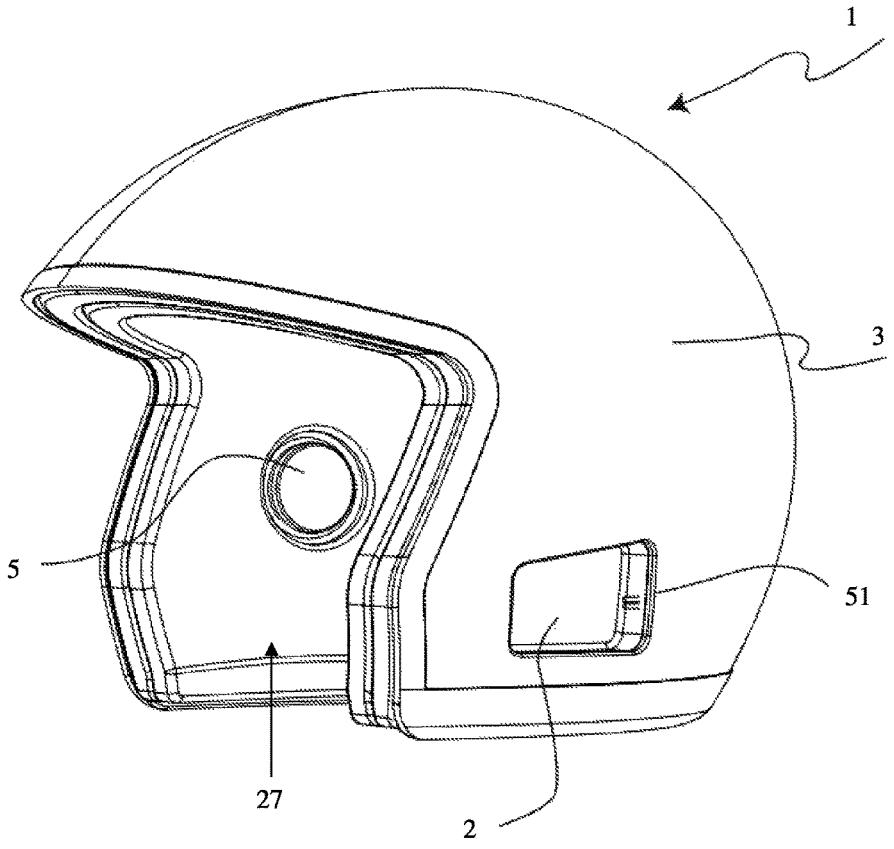
FIG. 1 shows the shell of a helmet according to one embodiment of the invention.

FIG. 1 shows a helmet 1, which has a shape typical in protective gear of the kind to which the invention refers. As shown, the helmet is of a type having a front opening 27. A recessed portion 2 is provided at the outer surface 3 of the helmet shell, which can conveniently house a communication apparatus such as a smart phone or a dedicated transmitter-receiver (commonly also referred to as "headset"). The communication apparatus may be connected to additional electronics (not shown) via connector 51. The shell of the helmet also comprises a seat 5, suitable to house an ear speaker for the wearer's right ear. A similar seat is typically provided also for the left ear, which is not seen in the perspective view of this figure. The shell shown in this figure can be fitted with a variety of equipment, as will be further described below.

Figure 2:
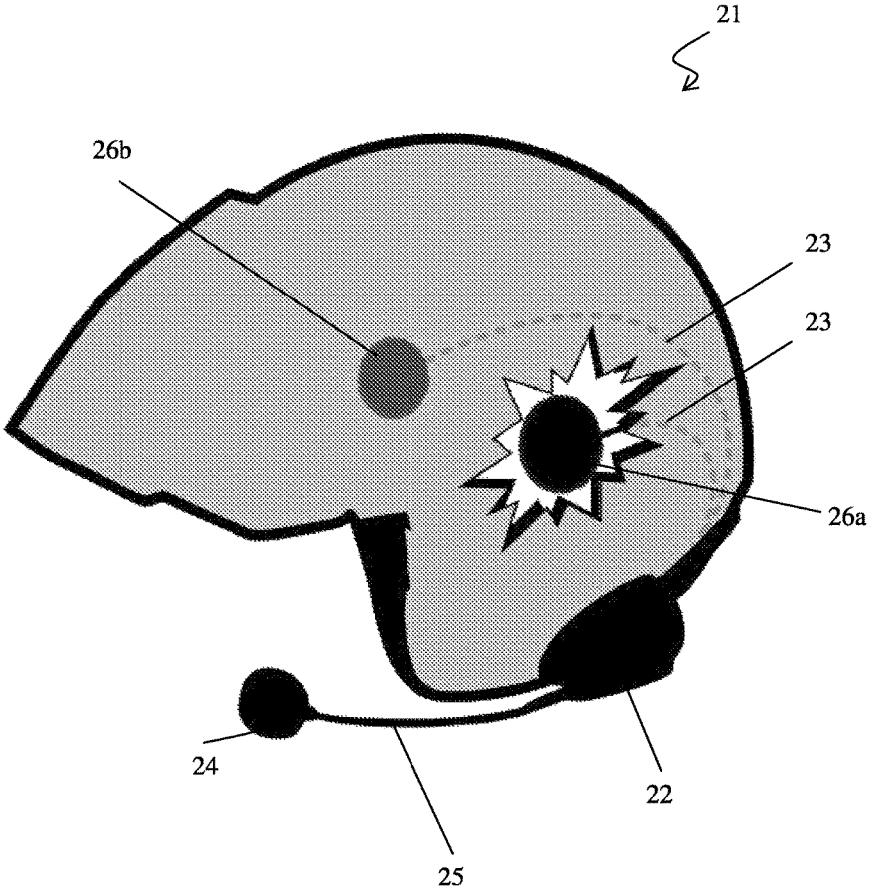
Fig. 2 (Prior Art)
FIG. 2 schematically illustrates the location of communication equipment within a helmet shell, as existing in the prior art.

Turning now to FIG. 2, a helmet constructed according to the prior art is generally indicated at 21 and is provided with electronics contained in housing 22, which is conventional and for the sake of brevity is not described herein in detail. Communication electronics (headset) 22 (which, in addition to circuitry may also house an antenna and any other desired elements) is connected to boom 25, which holds a microphone 24 at its distal end, close to the wearer's mouth. The boom typically has a form of a hollowed sleeve, to contain wires (not shown) between the headset and the microphone 24. The left and right ear-speakers 26*a* and 26*b* are connected to headset 22 via suitable wires 23. As noted above, this structure suffers from several drawbacks, particularly when used on board of a motorcycle. Such drawbacks mainly evolve from the exposure of the microphone and its boom to a front wind, engine noise, and rain.

Figure 3A:
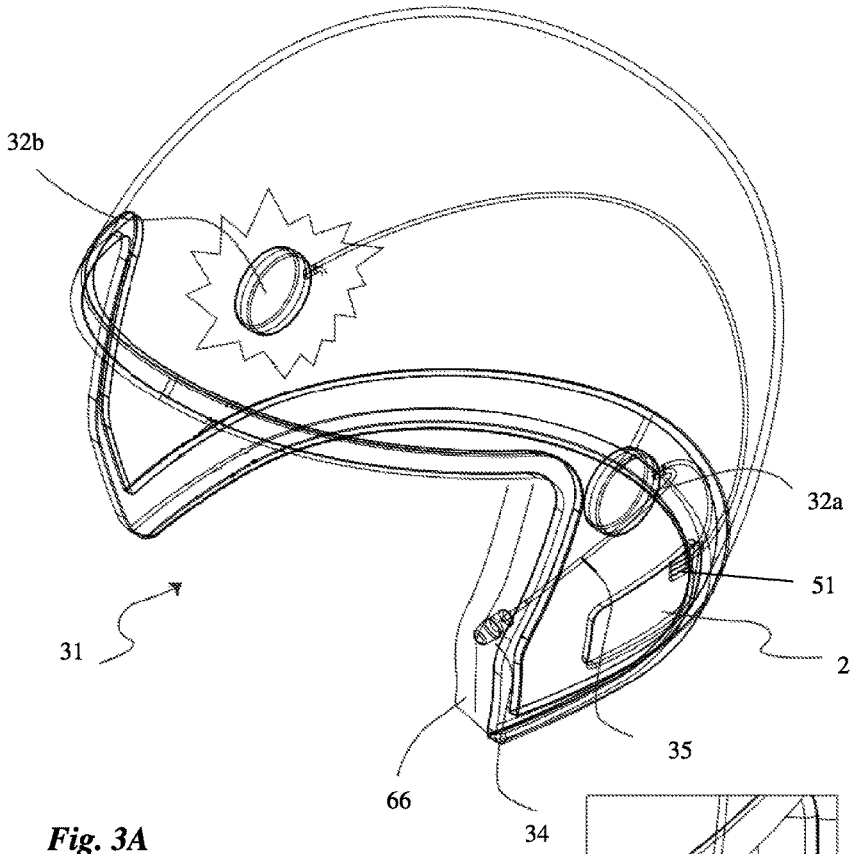
FIG. 3A schematically illustrates a helmet according to one embodiment of the invention.
Figure 3B:
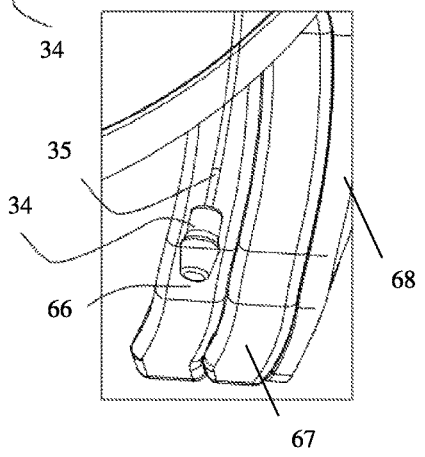
FIG. 3B is an enlarged view of a detail of the helmet of FIG. 3A, showing from a different angle the positioning of a microphone within layers of the helmet.
Figure 3C:
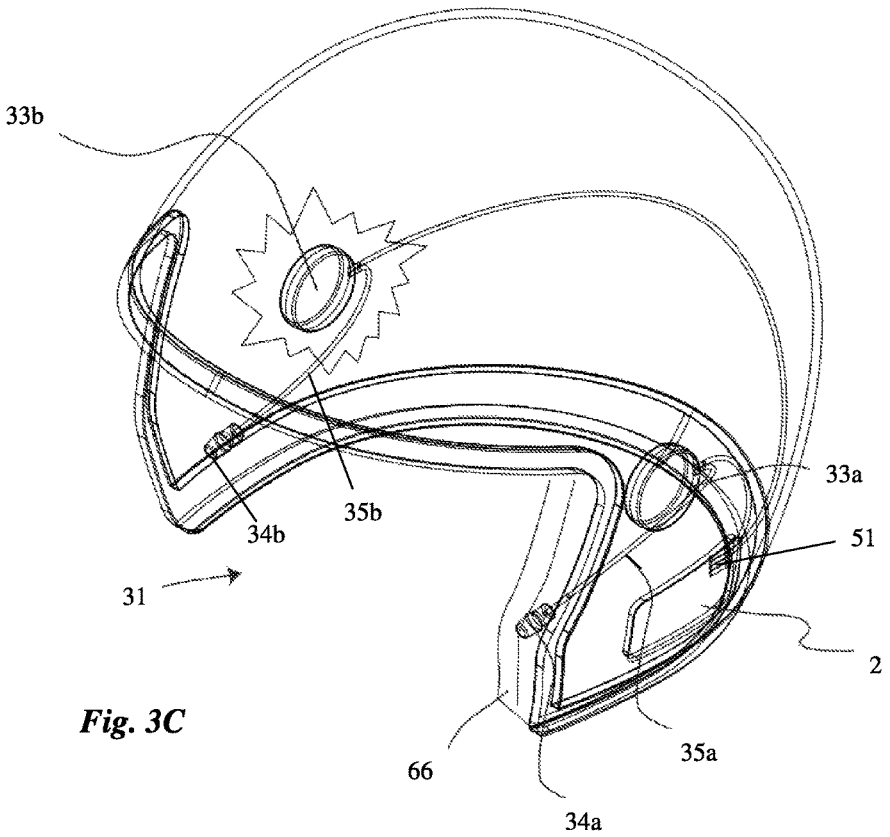
FIG. 3C shows an embodiment of the invention which comprises two microphones, one at each side of the helmet.

FIGS. 3A and 3B show a helmet generally indicated by numeral 31 which is used to illustrate the invention. The frame of the helmet comprises three layers that are best shown in FIG. 3B: a rigid exterior layer (also referred to as "shell") 68, a less rigid mid-layer 67 which is made of, for example, Styrofoam or similar material, and an interior soft layer 66. The helmet is provided with two ear speakers 32*a* and 32*b*, that are electrically connected to conventional electronics (not shown) provided at the helmet shell. As will be discussed in more detail hereinafter, the helmet is also provided with one microphone 34 (shown in FIGS. 3A and 3B) or two microphones 3*a* and 3*b*, as shown in FIG. 3C. In this particular embodiment a cavity 2 is provided for accepting the headset, as in the helmet of FIG. 1, although of course alternative wired or wireless solutions that may not require the existence of cavity 2 can be provided.

In the embodiment of FIGS. 3A and 3B, microphone 34 is connected to the electronics of the communication system via a connection element 35, which can be of any suitable type, such as one or more wires that may or may not be contained within a flexible boom having a form of a sheath or tubing. The connection element 35 and microphone 34 are embedded in the cheek pad (i.e., soft layer 66), or they may be embedded within the mid-layer 67 (and covered by the interior soft layer 66). In the embodiment of the invention shown in FIG. 3A, the connection element 35 connects the microphone 34 to a headset which resides within recess 2 via the speakers 33, although this is not obligatory. As noted, the connection element 35 preferably has a form of a boom, which may be convenient in some cases to provide both a mechanical support to microphone 34, as well as a guiding and protecting device for the respective wires. As seen in the figure, the assembled helmet consists of an outer rigid shell 68, which may have different thickness depending on construction materials and the intended use of the helmet, a mid-layer 67, and an interior soft layer 66. The soft layer 66 may be connected to the inner surface of the helmet in any suitable manner, e.g., it may be glued on or connected with mechanical fasteners such as Velcro surfaces, or may even be integrally created during injection of the shell.

It has now been found, and this is an object of the invention, that it is possible to maintain high-quality audio and to avoid or substantially reduce noise and disturbances from surrounding noise, by embedding the one or more microphones 34 (or 34*a* and 34*b*, when two microphones are used, as shown in FIG. 3C) within the mid layer 67 and/or interior layer 66. In such a manner, the microphone is substantially close to the wearer's cheek, while it is somewhat remote from the wearer's mouth (by "remote from the wearer's mouth" it is meant a distance of about 30-50 mm from the proximate end of the wearer's lips). This is a different approach from that of the prior art in which a single microphone, which is external of the outer shell of the helmet, is provided near the wearer's mouth—said microphone is adjustable and not embedded within any part of the helmet or padding thereof.

Figure 3D:
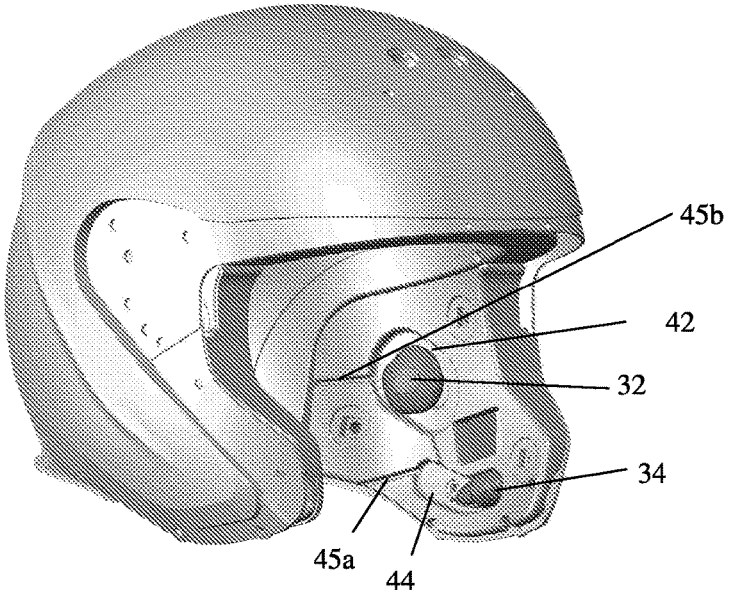
FIG. 3D shows the interior of the helmet, according to an embodiment of the invention.

FIG. 3D shows the interior of the helmet, according to an embodiment of the invention. One or more microphones 34 are embedded within one or more recesses 44 that are made within the mid-layer 67 respectively (the interior layer 66 is removed for the sake of brevity and is not shown in this figure). One or more slots 45 are provided respectively within at least one of the interior layer 66 or mid-layer 37, in order to enable embedding of the boom 35 or microphone wires within said slots. As shown, the microphone 34 is provided near the wearer's cheek, and somewhat remote from the wearer's mouth. The left speaker 32 is also shown, such that its wires are also embedded within one of the slots (45*b* in this case). The wires from the microphone 34 may be guided by slot 45*a* either directly to the headset (not shown), or to the speaker recess 42, and from there to the headset (together with the wires of the speaker).

Figure 4:
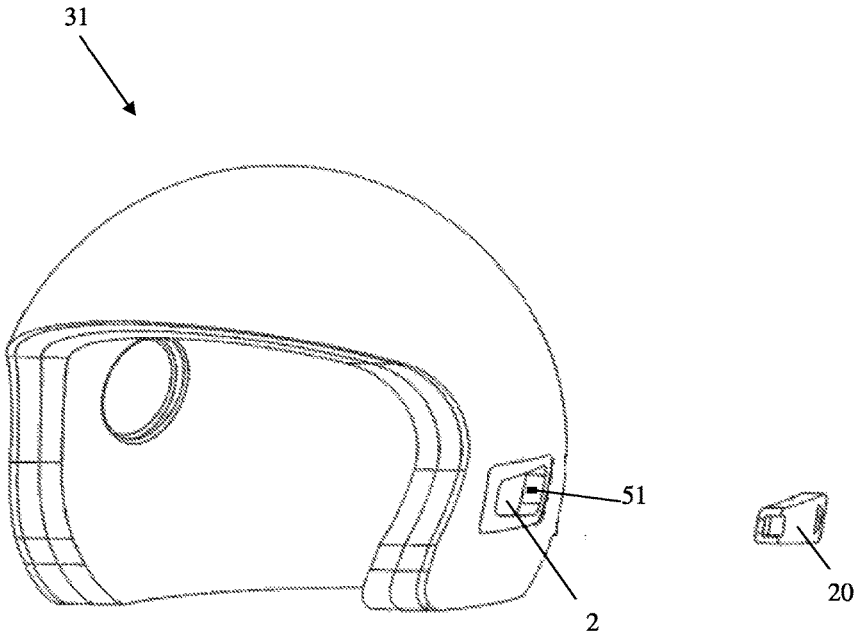
FIG. 4 illustrates a helmet according to yet another embodiment of the invention.

As shown in FIG. 4, the helmet 31 may comprise audio electronics (headset) 20, to be positioned within recess 2 and connected to the one or more microphones and speakers (not shown in this figure), e.g., via a connector 51. The one or more microphones and speakers are not seen in this figure, as they all embedded within the interior-layer 66 or mid-layer 67 respectively of the helmet 31.

As will be appreciated by the skilled person, the electronics provided in the helmet may provide additional functionality and does not have to be limited to two-way communication. For instance, speech detection components can be provided to allow for voice-activated functions. Additionally, the system can provide entertainment functions, such as radio or prerecorded music, which again can be manually operated or voice operated.

As will be appreciated by the skilled person, the invention achieves the desired results of both convenience and voice quality via the one or more microphones in a very simple and effective manner, by bringing the microphones into close vicinity with the wearer's cheek (somewhat remote from the wearer's mouth), while isolating to a great extent noise coming from outside. Because the materials of which the interior and mid-layers 66 and 67 respectively are made porous and dense, noise and vibrations are effectively stopped before reaching the microphone and cannot travel easily in a direction substantially parallel to the longitudinal axis of the microphone. Moreover, the fact that the one or more of cheek microphones, as well as their booms or wirings, are embedded within one or more of the mid-layer or interior layer enables much more convenience to the wearer.

The use of two microphones, as in the embodiment of FIG. 3C allows a greater flexibility in signal processing and noise canceling, as will be appreciated by persons skilled in this field. Obtaining two separate signals from two microphones spaced apart greatly helps in filtering noise and producing high quality sound for the receiver of the speech.

All the above description and exemplary embodiment of the invention have been provided for the purpose of illustration and are not intended to limit the invention in any way except as provided for by the appended claims.

The invention claimed is:

1. An open-front protective helmet provided with communication equipment, the helmet consists of a helmet shell;

at least one material layer, the at least one material layer (a) connects to an interior surface of the helmet shell, and (b) is configured to be positioned near a wearer's cheeks;

two spaced apart single-microphone units, the first single-microphone unit is (i) embedded in the at least one material layer, and (ii) configured to be next to the wearer's first cheek, and the second single-microphone unit is (a) embedded in the at least one material layer and (b) configured to be next to the wearer's second cheek;

wherein the first single-microphone unit is connected directly or indirectly to the communication equipment by means of a first connection element and the second single-microphone unit is connected directly or indirectly to the communication equipment by means of a second connection element, the first connection element is embedded within a first slot that is within the at least one material layer and the second connection element is embedded within a second slot that is within the at least one material layer, wherein the communication equipment is arranged to obtain two separate signals from the two spaced apart single-microphone units.

2. The protective helmet according to claim 1, wherein said communication equipment is a headset, and wherein the first connection element is flexible or rigid and the second connection element is flexible or rigid.

3. The protective helmet according to claim 1, wherein the first single-microphone unit configured to be next to the wearer's first cheek is at least 30 mm from the wearer's mouth, and the second single-microphone unit configured to be next to the wearer's second cheek is at least 30 mm from the wearer's mouth.

4. The protective helmet according to claim 1, wherein the connection element is rigid, having a form of a boom.

5. The protective helmet according to claim 2, wherein the flexible or rigid connection element is connected to an inner speaker.

6. The protective helmet according to claim 1, adapted to be used by a motorcycle driver and/or passenger.

7. The protective helmet according to claim 2, wherein the headset is suitable to provide voice operated functions.

8. The protective helmet according to claim 2, wherein the headset is suitable to provide entertainment functions.

* * * * *